US008079674B2

(12) United States Patent
Kurihara et al.

(10) Patent No.: US 8,079,674 B2
(45) Date of Patent: Dec. 20, 2011

(54) INK JET RECORDING APPARATUS

(75) Inventors: Yoshiaki Kurihara, Kawasaki (JP); Hirotaka Miyazaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 299 days.

(21) Appl. No.: 12/408,063

(22) Filed: Mar. 20, 2009

(65) Prior Publication Data

US 2009/0237452 A1 Sep. 24, 2009

(30) Foreign Application Priority Data

Mar. 24, 2008 (JP) ..... 2008-076102

(51) Int. Cl.
*B41J 2/05* (2006.01)

(52) U.S. Cl. ..... 347/65; 347/47

(58) Field of Classification Search ..... 347/40–43, 347/47, 64–65

See application file for complete search history.

(56) References Cited

U.S. PATENT DOCUMENTS 6,652,702 B2 11/2003 Miyazaki et al.
6,799,831 B2 10/2004 Inamoto et al.
7,410,247 B2 * 8/2008 Eguchi et al. ..... 347/65

FOREIGN PATENT DOCUMENTS

JP 2002-154209 5/2002

* cited by examiner

*Primary Examiner* — Lamson D Nguyen

(74) *Attorney, Agent, or Firm* — Fitzpatrick, Cella, Harper & Scinto

(57) ABSTRACT

An ink jet recording head includes a recording element substrate provided on one side thereof with a plurality of ejection outlet arrays each including a plurality of ejection outlets for ejecting recording liquid and provided on the other side thereof with a plurality of supply ports for supplying the recording liquid to the ejection outlet arrays, respectively; and a supporting member for supporting the recording element substrate by connecting with the other side of the recording element substrate. The supporting member has a plurality of supply passages for supplying the recording liquid to respective supply ports. The supporting member is provided with a partition between adjacent ones of the liquid passages, and at least one side of the partition is provided with pits and projections arranged alternately along a longitudinal direction of the partition.

7 Claims, 8 Drawing Sheets

INK JET RECORDING APPARATUS

FIELD OF THE INVENTION AND RELATED ART

The present invention relates to an ink jet recording head for recording on various recording media, such as paper, thread, fiber, cloth, leather, metal, plastic, glass, lumber, ceramic, etc.

An ink jet recording method is a recording method which records an image on recording medium by creating droplets of recording liquid, and adhering the droplets of recording liquid to the recording medium. This recording method is extremely small in recording noise, and also, is capable of recording at a high speed. Further, a recording head which uses this recording method can be made extremely small in size. Thus, an ink jet recording method may be said to be advantageous as a recording method for a color recording head, and also, a small recording head.

FIG. 7 is a perspective view of a typical ink jet recording head. It shows the general structure of the recording head. The ink jet recording head 1100 shown in FIG. 7 has a recording chip 1101, an electric wiring board 1102, a recording chip supporting member 1150, and a recording liquid container 1109. The recording chip 1101 is for ejecting droplets of recording liquid. The recording chip 1101 and electric wiring board 1102 are attached to the recording liquid container 1109.

FIGS. 8(A) and 8(B) are plan views of the outward (front) and inward (rear) surfaces, respectively, of the recording chip 1101 shown in FIG. 7, and show the general structure of the recording chip 1101. FIG. 9 is a plan view of the recording chip supporting surface of the supporting member, to which the recording chip 1101 shown in FIG. 7 is adhered.

The recording chip 1101 is attached to the recording chip supporting surface 1115 of the supporting member 1150 by its inward (rear) surface, with the use of adhesive 1104. The supporting member 1150 is solidly attached to the recording liquid container 1109 after the bonding of the recording chip 1101 to the recording chip supporting member 1150. The recording liquid in the recording liquid container 1109 is supplied to the main recording liquid passages 1105 of the recording chip 1101 through the holes 1106 of the supporting member 1150. Then, the recording liquid is ejecting out of the recording chip 1101, and adheres to recording medium; an image is formed on the recording medium. More specifically, in the recording chip 1101, the recording liquid is heated by the heating elements (unshown), with which the recording chip 1101 is provided. As a result, the recording liquid is jetted out of the recording liquid ejecting orifices of the recording chip 1101, by the pressured generated by the heating of the recording liquid.

In recent years, demand has been increasing for recording apparatuses capable of printing a high quality image at a high speed. One of the known solutions for increasing an ink jet recording apparatus in recording speed is to provide the ink jet recording apparatus with a larger recording chip, that is, a recording chip having a larger number of ink ejecting orifices. One of the known solutions for improving an ink jet recording apparatus in image quality is to provide the recording apparatus with a recording chip which is higher in ink ejecting orifice density. However, the cost for manufacturing a recording chip which is larger in size, and/or higher in ink ejecting orifices, is substantially higher than that for an ordinary recording chip. Thus, in order to realize a recording chip which is faster in record speed and higher in image quality, it is necessary to more precisely and reliably bond the abovementioned supporting member and recording chip to each other. One of the technologies for more precisely and reliably bonding the supporting member and recording chip to each other is disclosed in Japanese Laid-open Patent Application 2002-154209. In the case of the recording chip disclosed in this patent application, its main and branch passages for recording liquid were reduced in pitch to yield this recording chip which is higher in ink ejecting orifice density.

In a case where a supporting member, having the holes as the recording liquid passages, is manufactured by molding, the normal accuracy of the recording chip adhesion area of the supporting member is roughly 50 μm. Here, "accuracy of the recording chip adhesion area" means the difference in height between the highest and lowest points of the recording chip adhesion area of the supporting member. Unless the recording chip adhesion area of the supporting member is perfectly flat, there occur gaps between the chip adhesion area of the supporting member and the recording chip, and/or the recording chip becomes tilted relative to the recording chip adhesion area, as the recording chip is placed on the recording chip adhesion area of the supporting member. In order to prevent these problems, adhesive is used to attach the recording chip to the supporting member to compensate the unevenness of the recording chip adhesion area of the supporting member. As for the method for applying adhesive to the recording chip adhesion area of the supporting member, generally, the adhesive is directly exuded onto the recording chip adhesion area from the needle of an adhesive dispenser.

However, the following problem occurred during the manufacturing of a recording chip designed to be significantly narrower in the interval between the adjacent main recording liquid passages 1105 than conventional recording chips, in order to further reduce recording chip cost. That is, narrowing of the interval between the adjacent two main recording liquid passages 1105 of the recording chip required modifying the interval (pitch) of the recording liquid passages (holes) of the supporting member 1150. Further, in order to ensure that the recording chip is supplied with a satisfactory amount of recording liquid, each of the recording liquid passages (hole) cannot be reduced in the size of its opening in terms of its cross-section. Therefore, the only solution is to reduce in thickness the partitioning wall between the adjacent two main recording liquid passages (holes) of the supporting member 1150. In other words, each partitioning wall of the recording chip supporting member 1150 has to be no more than 0.5 mm, for example, in thickness, which is extremely thin. In a case where the partitioning wall of the recording chip supporting member 1150 is no more than 0.5 mm in thickness, it is impossible to reliably apply adhesive to the partitioning wall, using a conventional method for applying adhesive to bond the recording chip to the supporting member; as adhesive was applied, the adhesive flowed into the recording liquid passages of the supporting member. The analysis of this problem revealed that in order to properly apply adhesive to each partitioning wall, the adhesive application needle has be positioned significantly more precisely relative to each partitioning wall in terms of both the X and Y directions in FIG. 9 than it used to be. The conventional needle positioning accuracy is in a range of ±100 μm. However, it became evident from the abovementioned analysis that in a case where the recording liquid passage pitch of the supporting member is as small as described above, the needle positioning accuracy must be in a range of ±25 μm.

The adhesive application needle positioning accuracy can be improved by reducing the needle in diameter. However, the reduction in the needle diameter increases the needle in the flow resistance between the needle and the adhesive, which results in decrease in the amount by which the adhesive can be exuded per unit length of time from the needle. In other words, the reduction in the diameter of the adhesive application needle results in an increase in the length of the time for applying the adhesive to each supporting member, which in turn results in the reduction in the productivity of a recording head factory, and also, increase in recording head cost. Thus, this solution, that is, simply reducing in diameter the adhesive application needle, is not desirable.

SUMMARY OF THE INVENTION

Thus, the primary object of the present invention is to provide an ink jet recording head which is significantly higher in the pitch of the main recording liquid passages than any of conventional ink jet recording heads, and yet, is as reliable as, or more reliable than any of conventional ink jet recording heads, in terms of the bond between its recording chip and recording chip supporting member, and also, is as good as, or superior to, any of conventional ink jet recording heads, in terms of manufacturing efficiency.

According to an aspect of the present invention, there is provided an ink jet recording head comprising a recording element substrate provided on one side thereof with a plurality of ejection outlet arrays each including a plurality of ejection outlets for ejecting recording liquid and provided on the other side thereof with a plurality of supply ports for supplying the recording liquid to the ejection outlet arrays, respectively; and a supporting member for supporting said recording element substrate by connecting with said other side of said recording element substrate, said supporting member has a plurality of supply passages for supplying the recording liquid to respective supply ports, wherein said supporting member is provided with a partition between adjacent ones of said liquid passages, and at least one side of said partition is provided with pits and projections arranged alternately along a longitudinal direction of said partition.

The present invention makes it possible to provide an ink jet recording head which is significantly higher in the pitch of the main recording liquid passages than any of conventional ink jet recording heads, and yet, is as reliable as, or more reliable than any of conventional ink jet recording heads, in terms of the bond between its recording chip and recording chip supporting member, and also, is as good as, or superior to, any of conventional ink jet recording heads, in terms of manufacturing efficiency.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

Figure 1:
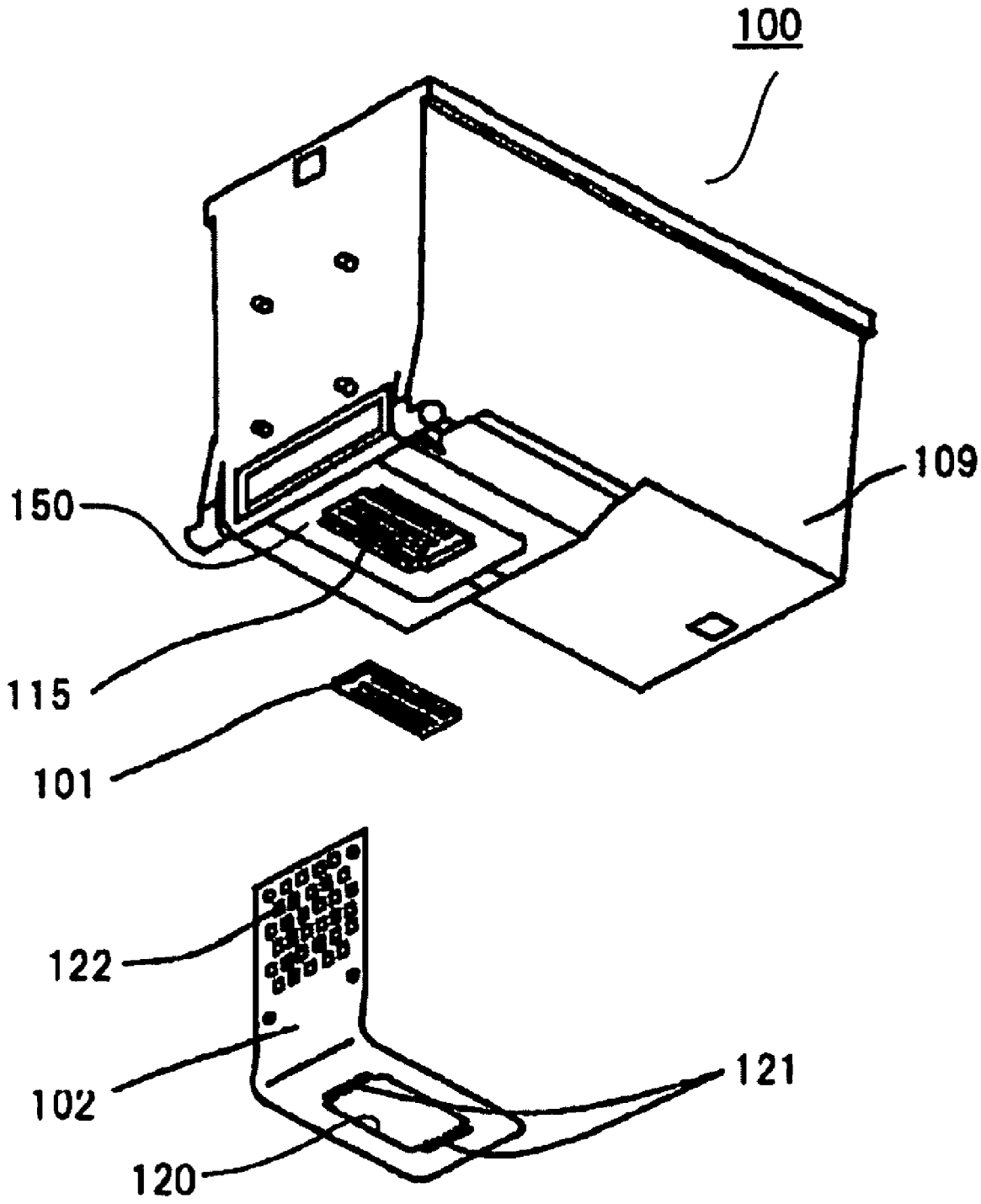
FIG. 1 is a partially exploded perspective view of the ink jet recording head in the first preferred embodiment of the present invention.

FIG. 1 is a partially exploded perspective view of the ink jet recording head in the first preferred embodiment of the present invention.

Figure 8:
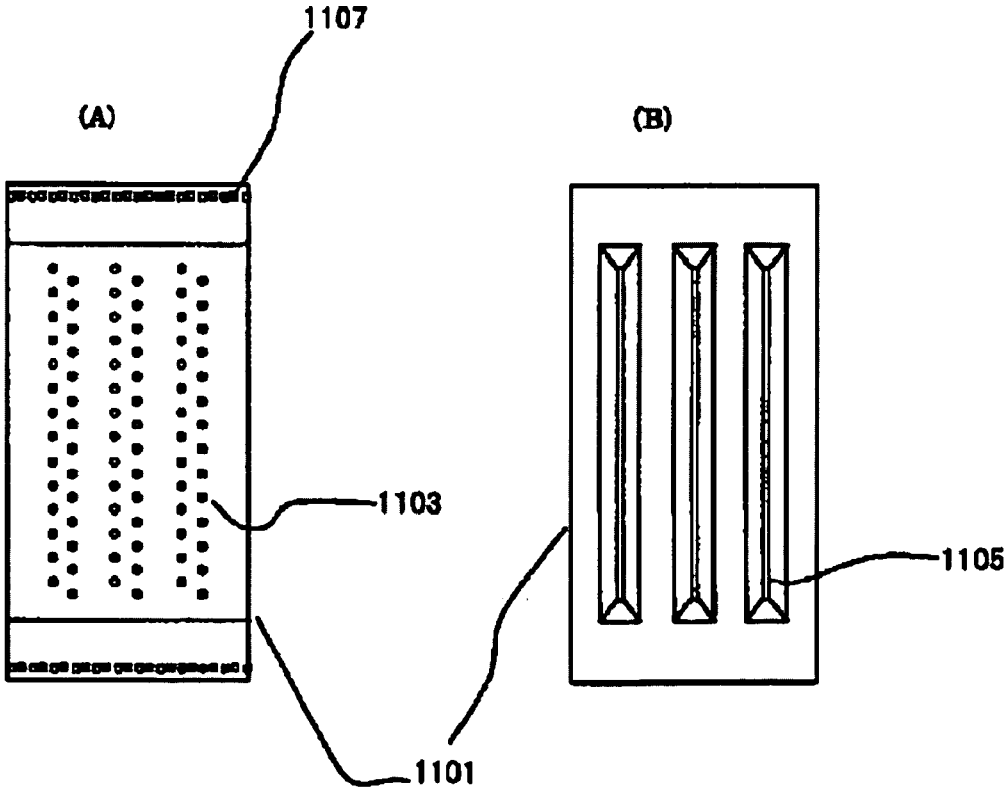
FIGS. 8(A) and 8(B) are plan views of the front (outward) and rear (inward) surfaces, respectively, of the recording chip shown in FIG. 7, which show the general structure of the recording chip.
Figure 9:
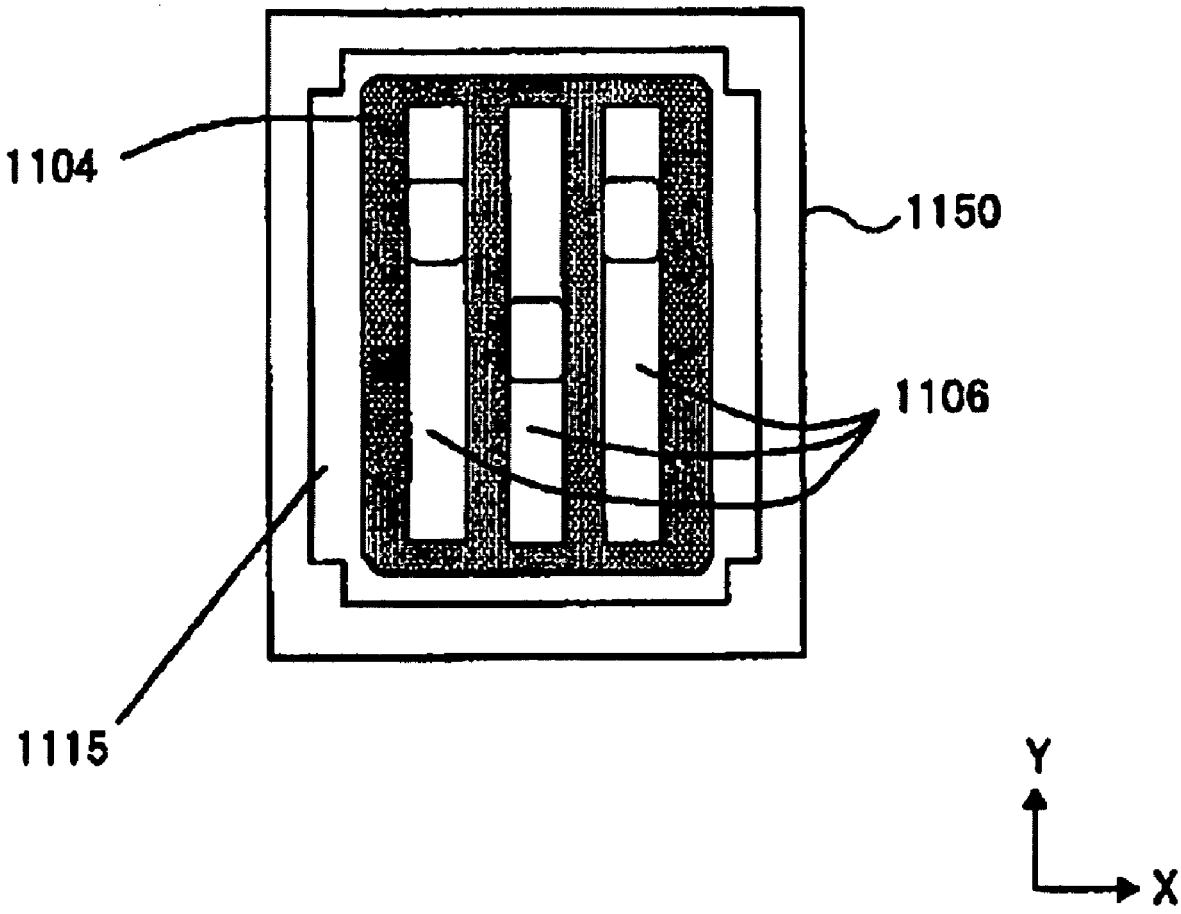
FIG. 9 is a plan view of the recording chip supporting surface of the recording chip supporting member, to which the recording chip shown in FIG. 7 is bonded.

The ink jet recording head 100 has a recording liquid container 109, which is made up of a container proper and a lid (unshown in FIG. 1) for covering the container proper. The recording liquid chamber, that is, the spaces formed by the container proper and lid, is filled with yellow (Y), magenta (M), and cyan (C) color inks, one for one. Further, each recording liquid storage space contains an absorbent member (unshown) for retaining recording liquid. The ink jet recording head 100 has also a recording chip supporting member 150 (which hereafter will be referred to simply as supporting member), to which the recording chip 101 for ejecting recording liquid is bonded. The supporting member 150 is attached to the bottom of the recording liquid container 109. The recording chip 101 has: heat generating elements, branch recording liquid passages, recording liquid ejecting orifices, and main recording liquid passages, etc., which are formed prior to the attachment of the recording chip 101 to the supporting member 150 (none of them are shown in drawing). More specifically, the recording chip 101 is provided with: multiple liquid ejecting orifices, and multiple main recording liquid passages (openings). The liquid ejecting orifices are open in multiple straight columns, on one of the primary surfaces of the recording chip 101, whereas the main recording liquid passages are open in parallel on the other primary surface of the recording chip 101. Incidentally, the structure of the recording chip 101 in this embodiment is the same as that described with reference to FIG. 8, and therefore, will not be described in detail here.

The recording chip 101 is bonded to the electrical wiring board 102. The electrical wiring board 102 is provided with a device hole 120 for recording chip 101, and electrical terminals 121, with which the wiring board 101 is connected to the electrodes of the recording chip 100. The electrical wiring board 102 is also provided with external signal input terminals 122, through which control signals are received by the recording chip 101 from the main assembly of the recording apparatus. The external signal input terminals 122 are in connection with the electrical terminals 121, through the wiring formed of copper foil.

Figure 2:
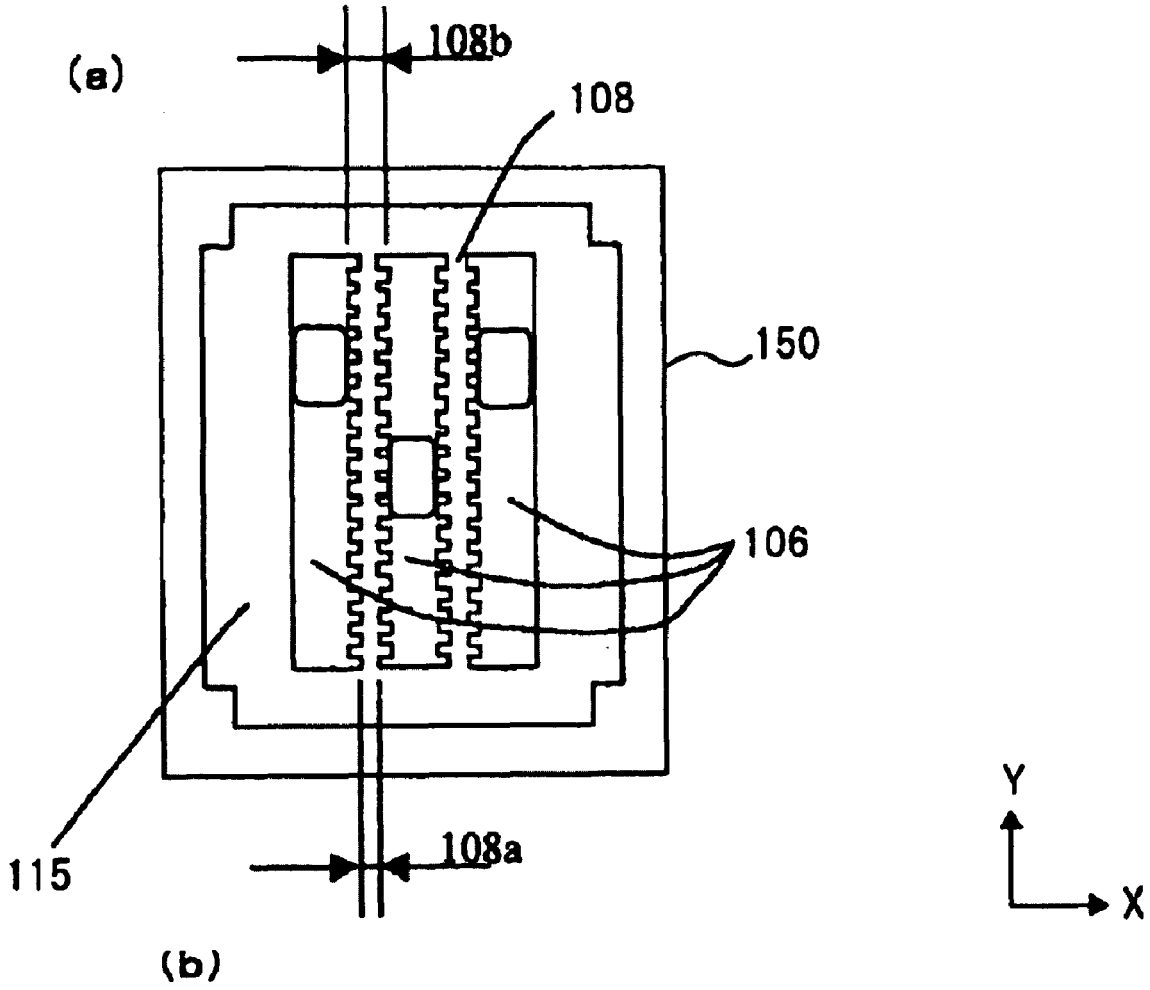
FIGS. 2(*a*) and 2(*b*) are plan and enlarged views of the recording chip supporting surface of the recording chip supporting member, to which the recording chip of the ink jet recording head shown in FIG. 1 is attached.
Figure 2:
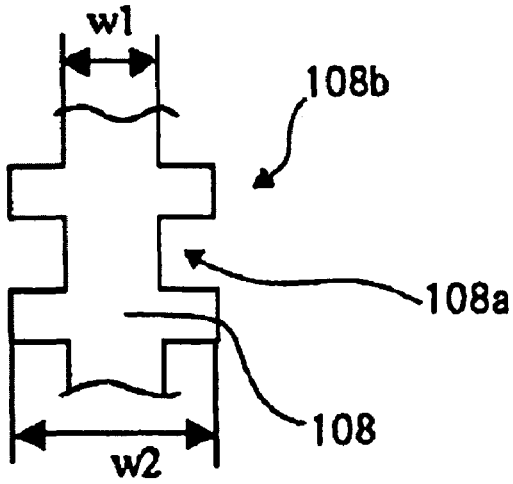

FIG. 2(*a*) is a plan view of the recording chip supporting surface of the supporting member, to which the recording chip of the ink jet recording head shown in FIG. 1 is bonded. FIG. 2(*b*) is an enlarged view of a part of the recording chip bonding area of one of the partitioning walls of the supporting member 150.

The supporting member 150 for supporting the recording chip 101 is molded of a resinous substance, which in this embodiment is a mixture of a resin and the glass filler which is mixed by 35% to yield a supporting member superior in rigidity. The supporting member 150 has multiple recording liquid passages for supplying the main recording liquid passages of the recording chip 101 with the recording liquids stored in the recording liquid chambers, one for one. There is a partition wall 108 between the adjacent two recording liquid passages 106, in order to prevent recording liquid of one color from mixing with recording liquid of another color.

Each vertical surface (surface perpendicular to recording chip supporting surface) of each partitioning wall is provided with multiple protrusions 108*b*, which are arranged in the lengthwise direction of the partitioning wall 108 with equal intervals, creating multiple recesses 108*a* with equal intervals. In this embodiment, these protrusions 108*b* (recesses 108*a*) are shaped so that their edges are straight. Further, the thickness w1 of the partition wall 108, that is, the thickness corresponding to the recess 108*a*, is 0.4 mm, and the thickness w2 of the partitioning wall 108, that is, the thickness corresponding to the protrusion 108*b*, is 0.7 mm. Further, the measurement (thickness) of the protrusion 108*b* in terms of the lengthwise direction of the partitioning wall 108 is 0.4 mm, and so is the measurement of the recess 108*a*. The pitch of the protrusions 108*b* is 0.8 mm. Further, the measurement (depth) of the recess 108*a* in terms of the direction perpendicular to the surface of the paper on which FIG. 2 is drawn, is 0.4 mm. Further, in this specification of the present invention, the referential plane for the recess 108*a* and protrusion 108*b* is the plane which is parallel to the vertical walls of the partitioning wall 108 and coincides with the mid point between the deepest point of the recess 108*a* and highest point of the protrusion 108*b* in terms of the direction X of the partitioning wall 108*a*.

Figure 3:
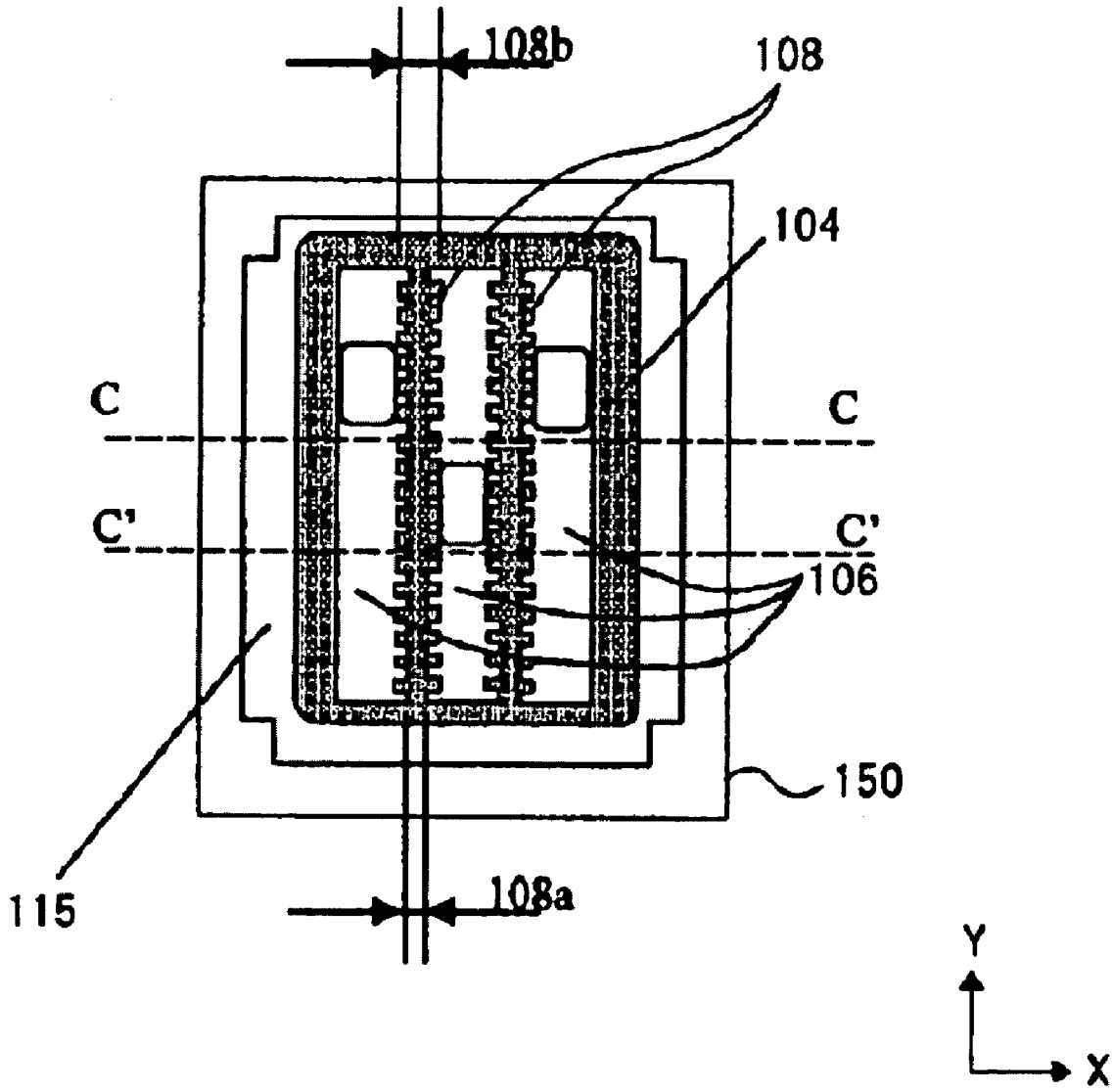
FIG. 3 is a schematic plan view of the recording chip supporting member, shown in FIG. 2, after the coating of the recording chip supporting member with adhesive across its recording chip bonding area.
Figure 4:
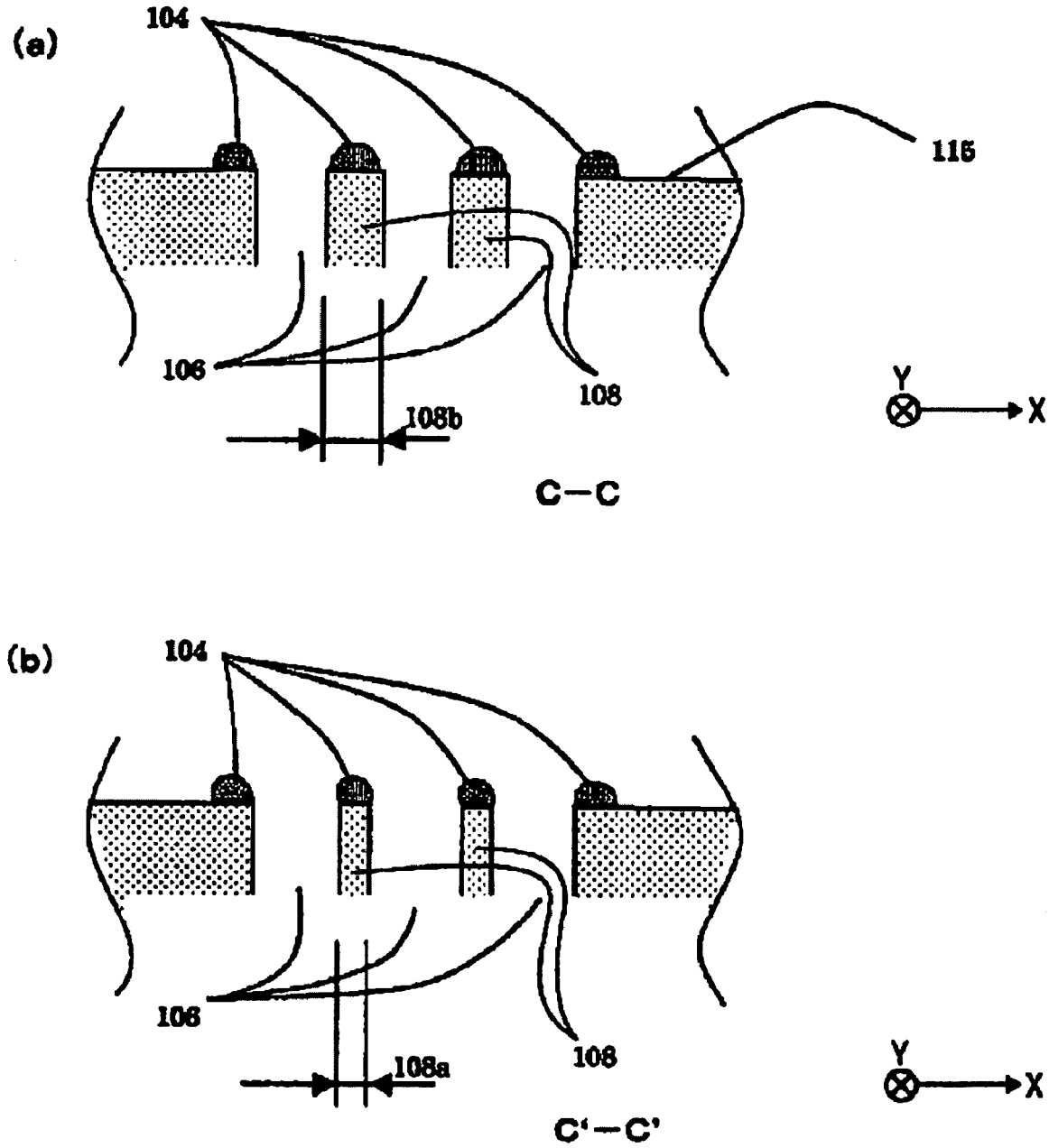
FIGS. 4(*a*) and 4(*b*) are sectional views of the recording chip supporting portion of the recording chip supporting member, at planes C-C and C'-C', respectively, in FIG. 3.
Figure 5:
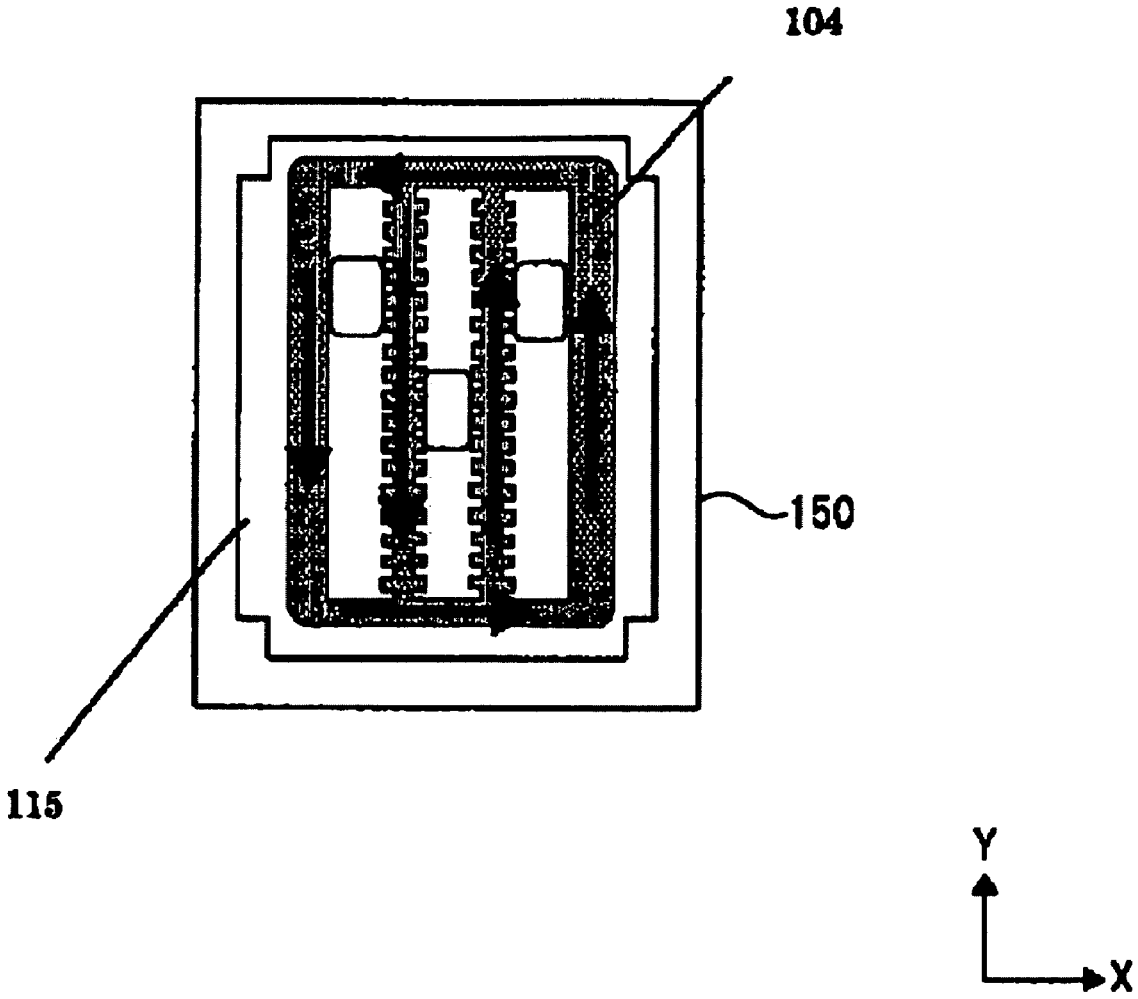
FIG. 5 is a schematic plan view of the recording chip supporting surface of the recording chip supporting member, which shows the area of the recording chip supporting surface, which is to be coated with the adhesive, and the directions in which the adhesive is to be applied with an adhesive dispenser.

Next, referring to FIGS. 3-5, the steps for applying adhesive 104 to the recording chip supporting area 115 of the supporting member 150 with the use of an adhesive dispenser will be described. FIG. 3 is a schematic plan view of the recording chip supporting area of the supporting member 150 after the coating of the recording chip supporting area (shown in FIG. 2) of the supporting member 150 with the adhesive. FIGS. 4(*a*) and 4(*b*) are sectional views of the recording chip supporting area of the recording chip supporting member, at planes C-C and C'-C', respectively, in FIG. 3. FIG. 5 is a schematic plan view of the recording chip supporting surface of the recording chip supporting member, which shows the area of the recording chip supporting surface, which is to be coated with the adhesive, and the directions in which the adhesive is to be applied with an adhesive dispenser.

As for the adhesive choice, any adhesive may be selected from among the adhesives which can remain in the shape in which they are applied, after they are applied to the partitioning wall 108. The adhesive used in this embodiment is such an adhesive that is 14,000 mPa×s in viscosity, and 1.8 in thixoratio. The needle of the dispenser was 0.4 mm in diameter.

The adhesive 104 is applied to the recording chip supporting area 115 of the supporting member 150 and each of the partitioning walls 108, from the needle (unshown) of the dispenser. Referring to FIG. 5, the direction indicated by an arrow mark Y is the direction in which the needle is moved relative to the partitioning wall 108 when the adhesive 104 is coated on the partitioning wall 108. The direction indicated by an arrow mark X, which is perpendicular to the direction in which the needle is moved when the adhesive 104 is applied to the partitioning wall, is the direction in which each protrusion 108*b* of each partitioning wall 108 protrudes.

First, the steps for coating the partitioning wall 108 with the adhesive 104 by moving the needle along the center line of the partitioning wall 108, which is parallel to the lengthwise direction (Y) of the partitioning wall 108, will be described (assuming that amount of positional deviation of needle is 0 μm). As the adhesive 104 is applied from the needle to each of the portions of the partitioning walls 108, which corresponds in position to the protrusion 108*b*, the body of the applied adhesive 104 is spread across the entirety of this portion of the partitioning wall 108 (including protrusion 108*b*) by its own surface tension, and then, becomes stable in shape on this portion of the partitioning wall 108 because of its own viscosity (FIG. 4(*a*)). Thereafter, the needle is moved onto the portion of the partition wall 108, which corresponds to the recess 108*a*, while being made to continuously exude the adhesive 104 to coat this portion of the partitioning wall 108 with the adhesive. The body of the adhesive applied to this portion of the partitioning wall, that is, the portion which corresponds to the recess 108*a*, remains thereon because of its own viscosity (FIG. 4(*b*)). In addition, the body of the adhesive 104 applied to the partitioning wall 108 is prevented from flowing into the recording liquid passages 106, by the force generated by the meniscus which it forms along the edges between the recess and protrusion 108*b*; it remains stable in shape on the partitioning wall 108.

Next, a case in which the adhesive 104 is applied to the top surface of the partitioning wall 108, with the needle positioned 100 μm away from the center line (parallel to direction Y) of the partitioning wall 108 in the direction indicated by the arrow mark X, will be described. Also in this case, as the adhesive 104 is exuded from the needle while the needles is moved in the direction Y, the body of the applied adhesive 104 settles on the top surface of the partitioning wall 108, except that it settles slightly away from the abovementioned center line. Thus, as the body of the applied adhesive 104 settles on the top surface of the partitioning wall 108, it spreads beyond the edge of the recess 108*a*. However, as it spreads beyond the edge of the recess 108*a*, the portion of the body of the adhesive 104, which has spread beyond the edge of the recess 108*a*, is supported by the adjacent two protrusions 108*b*. Further, also in this case, as soon as the adhesive 104 is applied to the top surface of the partitioning wall 108, the body of the applied adhesive 104 is made to spread across the top surface of the partitioning wall 108 by its own surface tension, and yet, the body of the adhesive 104 on the top surface of the partitioning wall 108 is prevented from flowing into the recess 108*a*, by its own viscosity, and the meniscus which it forms along the edges between the recess and protrusion 108*b*. That is, also in this case, the adhesive 104 does not flow into the recess 108*a*; it remains stable on the top surface of the partitioning wall 108.

To summarize, in this embodiment, both of the vertical surfaces (surface perpendicular to recording chip supporting surface) of each partitioning wall are provided with multiple protrusions 108*b*, which are arranged in the lengthwise direction of the partitioning wall 108 with equal intervals, are multiple recesses 108*a* which also are arranged in the lengthwise direction of the partitioning wall 108 with equal intervals, so that the multiple protrusions 108*b* and multiple recesses 108*b* are alternately positioned in terms of the lengthwise direction of the partitioning wall 108. Therefore, even the bodies of the applied adhesive 104 on the portions of each of the partitioning walls 108 remain stable in shape. Further, even in the case where the adhesive 107 is exuded onto the partitioning wall 108 with the needle slightly displaced relative to the partitioning wall 108, the body of the adhesive 104 applied to the partitioning wall 108 satisfactorily remains on the partitioning wall 108.

Further, in this embodiment, both of the vertical surfaces (surface perpendicular to recording chip supporting surface) of each partitioning wall are provided with multiple protrusions 108*b* and multiple recesses 108*a*, which are arranged in the lengthwise direction of the partitioning wall 108 with equal intervals. However, as long as one of the two vertical surfaces of each partitioning wall 108 is provided with the above described protrusions 108*b* and recesses 108*a*, the partitioning wall 108 can satisfactorily retain the body of the applied adhesive 104.

Further, in this embodiment, all portions of the partitioning wall 108, which have protrusions 108*b*, are equal in the thickness w2. However, it is not mandatory that both of the vertical surfaces of each partitioning wall 108 are provided with multiple protrusions 108*b* and valleys 108*a*. That is, as long as one of the two vertical surfaces of the partitioning wall 108 is provided with the protrusions 108*b* and recesses 108*a*, the above described effect of satisfactorily holding the body of the applied adhesive 104 can be obtained.

In this embodiment, all the protrusions 108*b* are the same in the measurement w2 (thickness). However, it is not mandatory that the all the protrusions 108*b* are the same in the measurement w2. As a matter of fact, it is preferable that the protrusions 108*b* closer to the lengthwise ends of the partitioning wall 108 are greater in thickness w2 than those closer to the lengthwise center of the partitioning wall 108, for the following reason. That is, it is at the beginning of the process of applying the adhesive 104 to the top surface of the partitioning wall 108 with the use of the dispenser that it is highly possible for the body of the applied adhesive 104 to flow down into the main recording liquid passages. Therefore, structuring the partitioning wall so that the protrusions 108*b* closer to the lengthwise ends of the partitioning wall 108 are greater in thickness w2 than those closer to the center of the partitioning wall 108 is even more effective as the means for solving the problem that the adhesive 104 flows down into the main recording liquid passages after its application onto the top surface of the partitioning wall 108. Once the body of the applied adhesive 104 settles on the top surface of the protrusions 108*b*, it is prevented from flowing down into the main recording liquid passages, by the above described properties of the adhesive 104. Therefore, the protrusions 108*b* closer to the center of the partitioning wall 108 may be relatively small in terms of the thickness w2. That is, structuring the partitioning wall 108 so that some of the protrusions 108*a* are smaller than the rest is preferable in that it makes the main recording liquid (ink) passage greater in recording liquid capacity while ensuring that the recording chip remains satisfactorily adhered to the recording chip supporting member.

Comparative Example

In the comparative example to the above described first preferred embodiment, the adhesive 104 was applied to the top surface of the partitioning wall which is 0.4 mm in thickness. That is, the partitioning wall in the comparative example is different from those in the above described first preferred embodiment in that the vertical surfaces of each partitioning wall 108 are not provided with multiple protrusions and multiple recesses. In terms of the adhesive viscosity, amount by which the adhesive is exuded, needle diameter, and needle speed, this comparative example is the same as the above described first preferred embodiment.

In the case of the comparative example, as the adhesive was applied to the top surface of the partitioning wall, with the needle displaced by 50 μm in the direction perpendicular to the lengthwise direction of the partitioning wall, from the center line of the partitioning wall in terms of the widthwise direction of the partitioning wall, the adhesive flowed down from the top of the partitioning wall into the main recording liquid passages, and therefore, some of the main recording liquid passages were partially or fully plugged by the adhesive.

Embodiment 2

Figure 6:
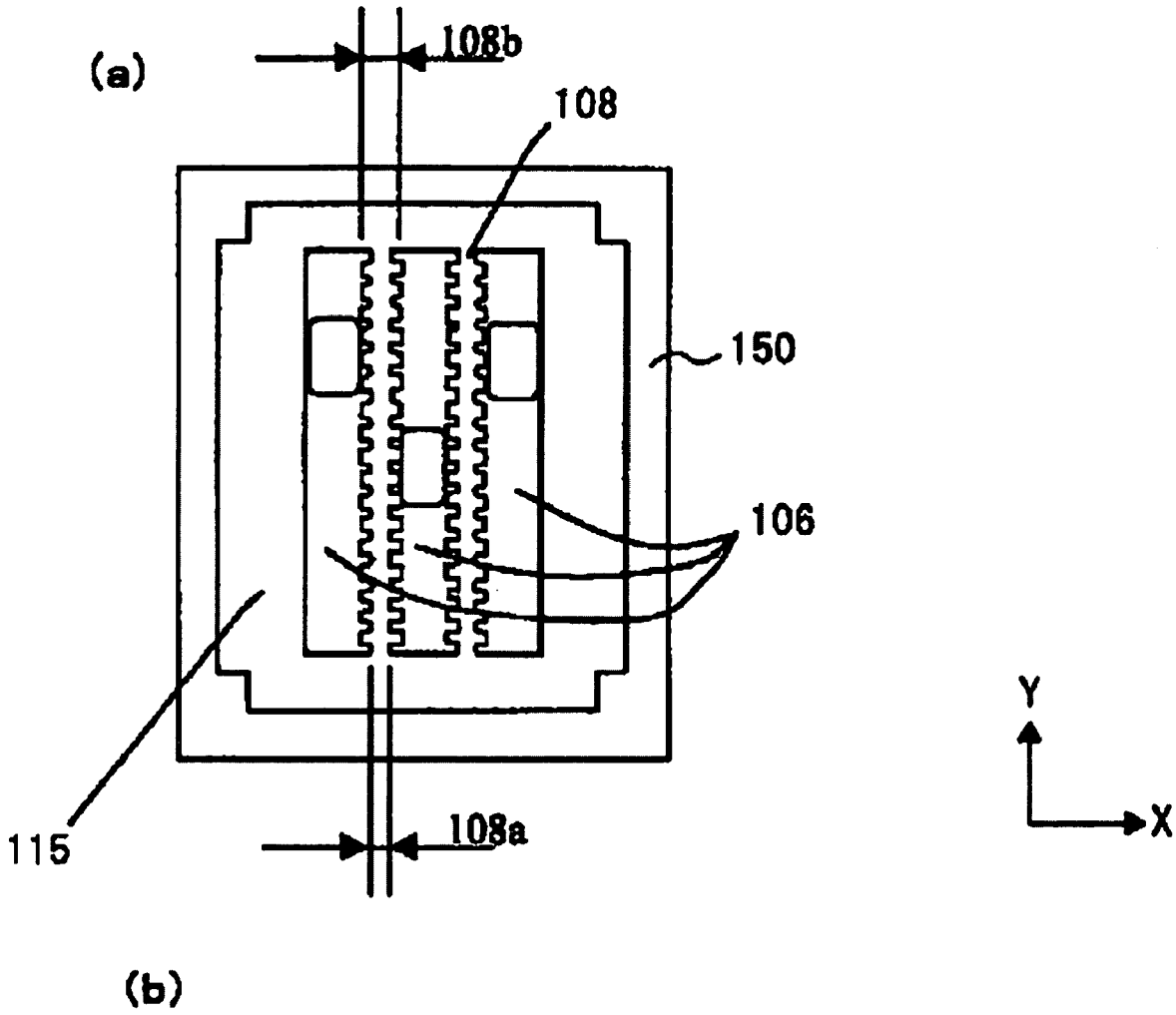
FIGS. 6(*a*) and 6(*b*) are plan and enlarged views of the recording chip supporting surface of the recording chip supporting member of the ink jet recording head in the second preferred embodiment of the present invention, to which the recording chip is to be bonded.
Figure 7:
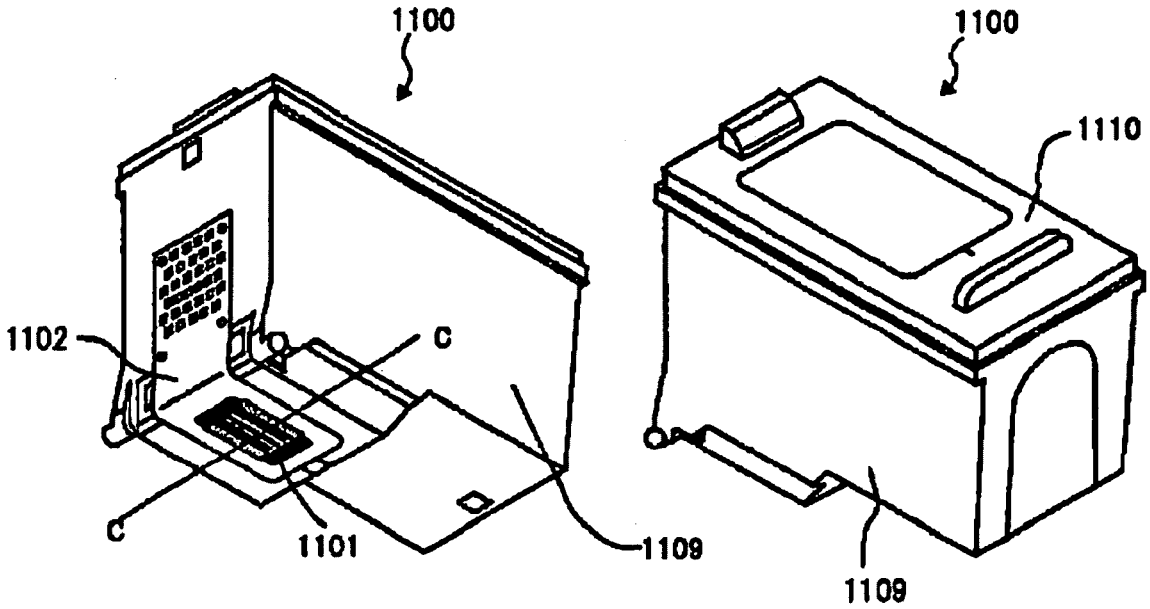
FIG. 7 is perspective views of the typical ink jet recording head as seen from the two different angles, which show the general structure of the ink jet recording apparatus.

FIG. 6(*a*) is a plan view of the recording chip facing surface of the supporting member, and FIG. 6(*b*) is an enlarged plan view of a part of one the partitioning walls of the supporting member 150.

Also in this embodiment, the recording chip is bonded to the supporting member 150, which has the partitioning walls 108, which has the protrusions 108*b* and recesses 108*a*, which are alternately positioned in terms of the lengthwise direction of the partitioning walls. However, in this embodiment, the protrusion 108*b* and recesses 108*a* are shaped so that their contours, at a plane which is parallel to the primary surfaces of the supporting member 150, are made up of straight lines and curved lines. More specifically, the contour of the cross section of each recess 108*a* has a curvature that protrudes toward the centerline of the partitioning wall 108, which is parallel to the lengthwise direction of the partitioning wall 108. Further, also in this embodiment, the portion of the partitioning wall 108, which corresponds in position to the recess 108*a* is 0.4 mm in thickness, whereas the portion of the partitioning wall 108, which corresponds in position to the protrusion 108*b*, is 0.7 mm in thickness. Further, the measurements of the recess 108*a* and protrusion 108*b* in terms of the lengthwise direction of the partitioning wall 108 are both 0.4 mm, and the pitch of the protrusions 108*b* is 0.8 mm. Further, the depth of the recess 108*a* in terms of the direction perpendicular to the surface of FIG. 6 is 0.4 mm.

Also in this embodiment, an adhesive which was 14,000 mPa×s in viscosity, and 1.8 in thixo-ratio was used as the adhesive 104. Further, the diameter of the needle of the adhesive dispenser was 0.4 mm in diameter as it is in the first embodiment. Further, the adhesive 104 was directly applied to the partitioning walls 108 and the other recording chip adhesion areas of the supporting member 150, from the needle (unshown) of the dispenser.

As the adhesive 104 was applied to the partitioning wall 108 while moving the needle following the center line of the partitioning wall, which is parallel to the lengthwise direction Y of the partitioning wall (assuming that positional deviation of needle relative to partitioning wall 108 is 0 μm), the partitioning wall 108 was satisfactorily coated with the adhesive 104. Further, even as the adhesive 104 was applied to the partitioning wall 108, with the needle displaced by 100 μm in the direction X from the center line of the partitioning wall 101, which is parallel to the lengthwise direction of the partitioning wall 108, the partitioning wall 108 was satisfactorily coated with the adhesive 104. Further, the supporting member was designed so that the contour of the surface of the partitioning wall 108 is made up of a combination of straight lines (which correspond to protrusions 108*b*) and curved lines (which correspond to recesses 108*a*). Thus, this embodiment is preferable to the first embodiment in that bubbles are less likely to become stagnant in the recesses of the main recording liquid passages of a recording head having the supporting member 150 in this embodiment than in a recording head having the supporting member 150 in the first embodiment. Further, the supporting member 150 can be formed by injection molding or the like. Therefore, a supporting member, the recesses of which are curved in cross section, is superior in terms of the separation from a mold, and therefore, it can be more satisfactorily formed than a supporting member, the recesses of which have straight lines in cross section. Therefore, this embodiment is preferable.

[Evaluation of Ink jet Recording Head Performance Recovery Based on Suction]

The ink jet recording heads in the first and second preferred embodiments were evaluated in their performance recovery based on bubble suction. Ordinarily, before an ink jet recording head begins to be used for an actual recording operation, an operation for restoring the ink jet recording head in performance is carried out. More specifically, recording liquid is suctioned through the recording liquid ejecting orifices by a mechanism with which the main assembly of the recording apparatus is provided to remove the bubbles in the main recording liquid passages 106 or the like in order to restore the recording head in performance That is, in order to prevent the mounting of an ink jet recording head into the main assembly of an ink jet recording head, from affecting the recording head in terms of image quality, the recording apparatus is designed so that as a recording head is mounted in the main assembly of the recording apparatus, the recording head is subjected to the above described operation for suctioning the recording head to remove the bubbles in the recording head to restore the recording head in performance.

Thus, the ink jet recording heads in the first and second preferred embodiments were evaluated in their performance regarding the performance restoration based on suction. More specifically, the ink jet recording heads were mounted in the main assembly of an ink jet recording apparatus, and were suctioned by the main assembly's performance recovery mechanism. Then, the ink jet recording heads were evaluated in recording performance. The recording head in the second embodiment recorded more satisfactory images than the recording head in the first embodiment. That is, the images formed by the recording head in the second embodiment showed virtually no sign of being affected by the presence of bubbles, even when the recording head in the second embodiment was made roughly 20% smaller in the amount by which recording liquid was suctioned than the recording head in the first embodiment. In addition, the recording head in the second embodiment was shorter than the recoding head in the first embodiment, in the length of time necessary for the performance recovery operation based on suction (length of time suctioning mechanism needs to be driven). That is, the recording head in the second embodiment was satisfactorily restored in recording performance even when it was made smaller than the recording head in the first embodiment, in the amount of load to which the suction-based recording performance restoration mechanism of the main assembly of the recording apparatus was subjected.

This result is attributable to the fact that the recording chip supporting member 150 of the recording head in the second embodiment is designed so that the contour of each of its recesses 108*a* is curved (FIG. 6). Therefore, it is easier for recording liquid to flow through the portion of the main recording liquid passages of the recording head in the second embodiment, which corresponds to the recess 108*a*, which is between the adjacent two protrusions 108*b* than that in the first embodiment. That is, bubbles are less likely to become stagnant in the recess 108*a* of the recording head in the second embodiment than that in the first embodiment. Therefore, the recording head in the second embodiment can be satisfactorily rid of bubbles even if it is smaller than the recording head in the first embodiment, in the amount by which recording liquid is suctioned.

[Miscellanies]

In the above given description of the first and second preferred embodiments of the present invention, only a couple of shapes were mentioned for the recess 108*a* and protrusion 108*b*. However, the two embodiments are not intended to limit the present invention in terms of the shape for the recess 108*a* and protrusion 108*b*. That is, the shapes for the recess 108*a* and protrusion 108*b* may be selected as fit, as long as the selected shapes are suitable for reliably retaining the adhesive 104 on the partitioning wall 108. In other words, the width of the recess 108*a*, width of the protrusion 108*a*, measurement of recess 108*a* in terms of the direction parallel to the lengthwise direction of the partitioning wall, measurement of the protrusion 108*b* in terms of the direction parallel to the lengthwise direction of the partitioning wall 108, pitch of the protrusions, may be set as fit. Further, the shape and depth for the recess 108*a* may be set as necessary, in consideration of the level of easiness at which the recording liquid is desired to flow through the main recording liquid passages, which corresponds in position to the recess 108*a*.

Further, each of the preferred embodiments and comparative example was described with reference to the ink jet recording heads structured so that the recording chip 101 and recording liquid container 109 are physically integral with each other. However, the present invention is applicable to an ink jet recording head, the recording chip 101 and recording liquid container 109 of which are physically independent from each other. Further, the two preferred embodiments and the comparative example were described with reference to the recording heads, the supporting member 150 of which for supporting the recording chip 101 was formed of a resinous substance. However, the supporting member 150 may be formed of a ceramic or the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 076102/2008 filed Mar. 24, 2008, which is hereby incorporated by reference herein.

What is claimed is:

1. An ink jet recording head comprising:

a recording element substrate provided on one side thereof with a plurality of ejection outlet arrays, each including a plurality of ejection outlets for ejecting recording liquid, and provided on the other side thereof with a plurality of supply ports for supplying the recording liquid to the ejection outlet arrays, respectively, said recording element substrate being provided with a plurality of heat generating elements; and a supporting member for supporting said recording element substrate by connecting with said other side of said recording element substrate through an adhesive, said supporting member having a plurality of supply passages for supplying the recording liquid to respective supply ports and a partition dividing a supply main passage into said plurality of supply passages, both sides of said partition constituting inner walls of adjacent liquid supply passages of said plurality of supply passages, wherein at least one side of said partition is provided with continual projections which include surfaces connected with said other side of said recording element substrate and which projects inwardly of said supply passages.

2. An ink jet recording head according to claim 1, wherein said projections are defined by substantially rectilinear lines as viewed from a side of said recording element substrate.

3. An ink jet recording head according to claim 1, wherein said projections are defined by combinations of rectilinear lines and curvilinear lines.

4. An ink jet recording head according to claim 3, wherein at least parts of said projections are defined by curvilinear lines.

5. An ink jet recording head according to claim 4, wherein the curvilinear lines project toward a center line in a longitudinal direction.

6. An ink jet recording head according to claim 1, wherein a length of one of said projections, measured in a direction in which said one projection projects, formed in a central part of said partition with respect to a longitudinal direction of said partition is shorter than that of another of said projections formed in an end part of said partition.

7. An ink jet recording head according to claim 1, wherein the adhesive is held by adjacent projections and a portion of said partition between said adjacent projections.

* * * * *